United States Patent [19]

Ng

[11] 4,249,332

[45] Feb. 10, 1981

[54] GUN SIGHT

[75] Inventor: Gim S. Ng, Newport News, Va.

[73] Assignee: The United States of America as represented by the Secretary of the Army, Washington, D.C.

[21] Appl. No.: 9,999

[22] Filed: Feb. 7, 1979

[51] Int. Cl.[3] ..... F41G 1/10

[52] U.S. Cl. ..... 42/1 S; 33/257

[58] Field of Search ..... 42/1 S; 33/258, 257, 33/254, 252

[56] References Cited

U.S. PATENT DOCUMENTS

| | | | |
|---|---|---|---|
| 1,523,319 | 1/1925 | Vosmek | 33/258 |
| 2,112,268 | 3/1938 | Burton | 42/1 S |
| 3,495,339 | 2/1970 | Elliason | 42/1 S |
| 3,662,469 | 5/1972 | Charron | 42/1 S |
| 3,838,522 | 10/1974 | Williams | 33/258 |

*Primary Examiner*—Charles T. Jordan

*Attorney, Agent, or Firm*—Nathan Edelberg; Robert P. Gibson; Norman L. Wilson, Jr.

[57] ABSTRACT

Sight devices of many guns are not wholly satisfactory. When guns such as .45 caliber automatic pistols are to be used in competitive target shooting, more expensive gun sights are utilized. Simpler gun sights are available but they present visual problems. A rear gun sight apparatus is provided herein which improves visual sighting or aiming, and it can be readily manufactured at a low cost and by simple manufacturing methods.

4 Claims, 9 Drawing Figures

GUN SIGHT

BACKGROUND OF THE INVENTION

This invention relates to an improved sight member for firearms, more particularly to a rear mounted gun sight.

The standard sight groove or "V" notch type rear sight has been in use for many years. However, as pointed out in *Armor*, January-February, 1978, p. 42 that type sight, particularly in the 0.45 automatic, should be improved. In fact when firearms thus equipped are to be used in competitive target shooting the Elliason sight shown in U.S. Pat. No. 3,495,339 is normally employed. As emphasized by Elliason, windage and elevation adjustments are needed for competitive target shooting.

Inasmuch as the Elliason sight does not lend itself to inexpensive manufacturing procedures, other more simple rear gun sights have been proposed which provide for adjustment of windage and elevation. One such rear gun sight is described in U.S. Pat. No. 3,975,851. Elevation adjustment is accomplished by sliding a wedge shaped elevation bar beneath the slight member. Another adjustable rear gun sight is the subject of U.S. Pat. No. 3,964,173. However, while providing for ease of construction and for windage and elevation adjustments, neither of these inventions is concerned, as is Elliason, with the visual glare and alignment problems encountered in aiming the gun. U.S. Pat. No. 3,975,851 employs a "V" notch and U.S. Pat. No. 3,964,173 provides a peep sight opening for sighting. The "V" notch is not sufficiently accurate because it requires a thin blade front sight which is difficult to see and is so weak as to be readily breakable. The peep sight is used only on shoulder weapons such as the carbine disclosed in U.S. Pat. No. 3,964,173, where the sighting eye is close to the gun sight.

In accordance with this invention, a rear gun sight apparatus is provided which improves visual sighting or aiming as well as being readily manufactured at a low cost and by such simple manufacturing methods that it can be retailed at a sufficiently low price to encourage widespread use thereof. Simpler gun sights are available but these are fixed sights and are not adjustable in the field. In addition these simpler sights whether adjustable or fixed, present a common visual problem. They are not completely glareproof. Provided herein is an adjustable rear gun sight designed to minimize glare, to improve visual sighting or aiming, and to be readily manufactured at a low cost by simple manufacturing methods.

SUMMARY OF THE INVENTION

The invention provided herein is an adjustable gun sight with an inherent glare proof sighting member.

A resilient sight leaf, and means biasing the sight leaf vertically for elevation adjustment are provided in combination with a double sight plate attached to the sight leaf, and adjustment means for sliding the double sight blade laterally for windage adjustment. The glare proof sighting member is a result of providing two sight plates of different geometric design disposed one behind the other in the line of sight. The rear sight plate, relative to the line of sight, is provided with a smaller notch than the front sight plate. The rear plate, again relative to the line of sight, also has different reflective properties from the front sight plate. These notch size and reflective property differences result in a silhoutted sighting groove.

DETAILED DESCRIPTION OF THE INVENTION

A more complete understanding of the invention and the advantages thereof will become apparent from the following description which refers to the accompanying drawings. In the drawings.

Figures 1, 2, 3, 4, 5, 6, 7, 8, 9:
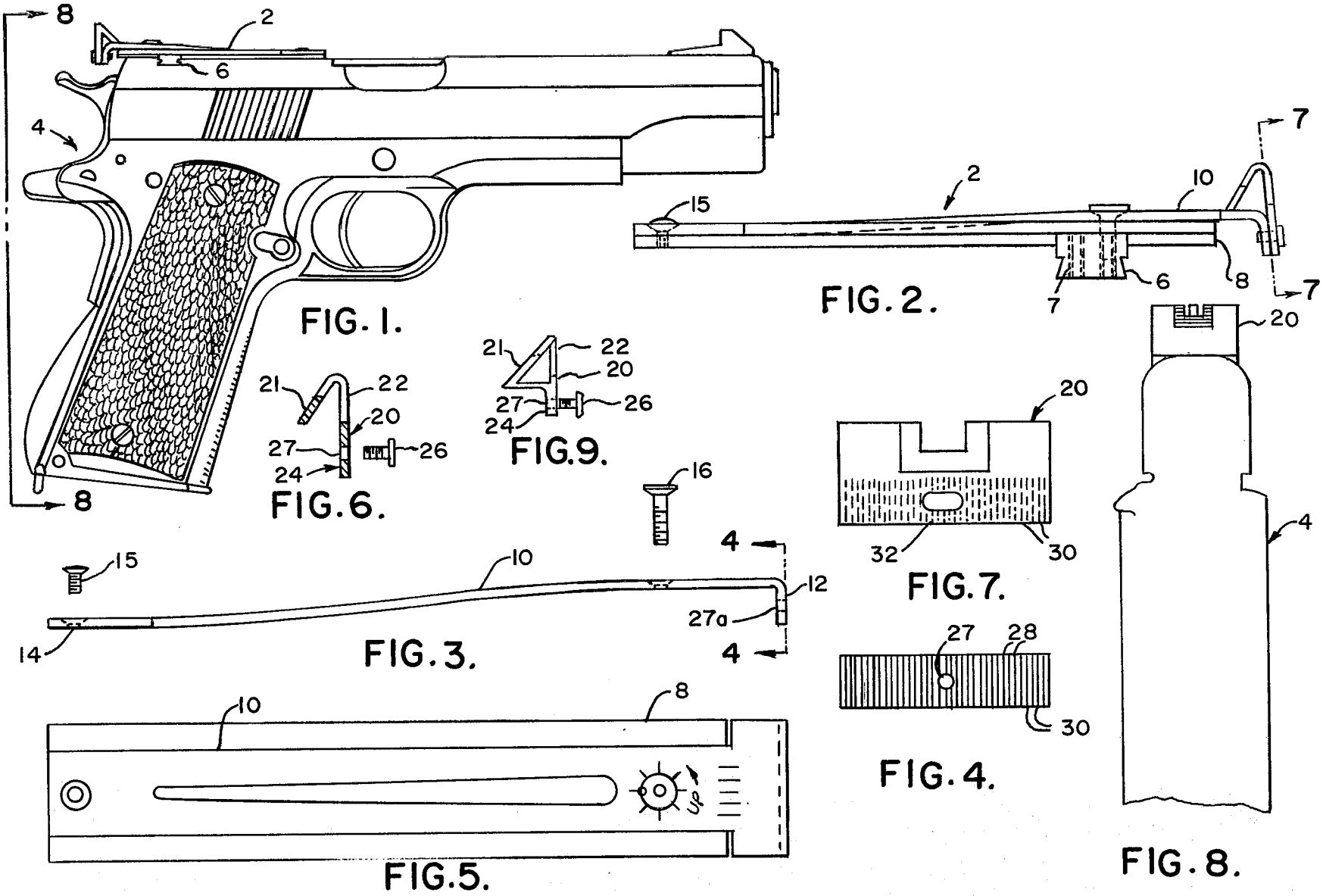
FIG. 1 is a side elevation of an automatic pistol showing the gun sight of the invention mounted thereon.
FIG. 2 is an enlarged side elevation of the gun sight.
FIG. 3 is a side elevation of the sight leaf.
FIG. 4 is a rear end view of the sight leaf.
FIG. 5 is a top view of the sight leaf.
FIG. 6 is a cross sectional view of a double sight plate.
FIG. 7 is a rear view of the double sight plate.
FIG. 8 is a rear view of sight member.
FIG. 9 is a cross sectional view of a modified sight plate made by extrusion.

As can be seen from the drawings, particularly FIG. 2, the invention herein provides an adjustable rear sight 2 for firearms. In FIG. 2 the rear sight 2 is shown attached to an automatic pistol 4 by means of dovetail fitting 6. Fitting 6 is made to fit the dovetail cut on the top of the gun.

The elements of rear sight 2 are shown in greater detail in FIGS. 2 thru 7. Dovetail fitting 6 is spot welded or brazed to the underside of a base plate 8. Base plate 8 is formed or machined channel member sufficiently rigid to function as a supporting frame for the rear sight 2.

To provide for elevation adjustment a resilient sight leaf 10 is employed. Sight leaf 10 is a leaf spring shaped so that it is inclined upwardly with a downwardly bent end 12 at one end as shown in FIG. 3. The spring is tempered to retain its resiliency in its positive slope and bent end configuration. The end of sight leaf 10 opposite the bent end, the low end, is provided with a small hole 14 for attachment by means of screw 15 to base plate 8. Sight leaf 10 is sized to fit in the channel of base plate 8 (FIG. 2) so that lateral movement of the sight leaf is prevented. Sight leaf 10 thus is biased vertically, but lateral movement of sight leaf 10 is prevented by the channel sides. Biasing is controlled by adjustment screw 16, which is retained by threads in dovetail fitting 6.

An important aspect of this invention is the silhoutted sighting notch. To form a half window which is shaded a double sight plate 20 is utilized. As is seen in FIGS. 6 and 9 the two sight plates 21 and 22 forming the double sight element can be attached at the tops as shown in FIG. 6 or extruded as shown in FIG. 9. The design shown in FIG. 6 is, of course, more desirable from the manufacturing point of view. The lower surface 24 of double sight plate 20 is adapted for attachment, by bolt or screw 26, hole 27, and threaded hole 27A, or other means, to the rear face of bent end 12 of sight leaf 10.

In another important aspect of the invention, means for windage adjustment are provided. The rear face of bent end 12, as shown in FIG. 4, is provided with fine serrated splines 28. Lower surface 24 of double sight plate 20 is also provided with fine serrated splines 30 so that the two surfaces mesh together in the form of interlocking plates. Eye 32 permits double sight plate 20 to be moved to various locking positions as windage adjustments require.

Referring now to the operation of the gun sight, fitting 6 attaches the sight to gun 4 and must be accurately milled to fit the dovetail cut on the gun for secure attachment. Sight leaf 10 is a formed or machined part that holds the double sight plate 20 securely in place and serves as the spring for sight adjustment. Double sight plate 20 is held by sight leaf 10, and rear sight adjustment for elevation is easily made by turning the vertical screw 16 in the desired direction. For instance, turning the screw 16 counterclockwise raises both the rear sight and, consequently, the imaginary point of bullet impact. The serrated cuts or splines at 28 and 30 permit incremental adjustment in the lateral direction. Lateral sight adjustment (horizontal or windage) is made by loosening screw 26 and pushing sight plate component 20 to the desired position, left or right and tighten screw 26 afterwards. The accurate fit of sight leaf 10 in channeled base plate 8 prevents lateral movement of the sight leaf. As seen in FIG. 8 the double sight plate 20 provides a silhouetted half window for accurate sighting. The silhouetted half window is a result of the front sight plate 21, relative to the line of sight of the one firing the gun, having different reflective properties from those of the rear plate 22. This can be achieved by various means. Thus, if the two sight plate 21 and 22 are not parallel, and particularly if the front plate 21, again relative to the aiming line of sight, slants toward the marksman, it will reflect light rays downwardly. In addition the two sight plates can be coated with different finishes to accent and position sights rapidly. For instance, front sight plate 21, in the line of sight, can be coated with a glare proof finish conferring thereon different reflective properties from rear sight plate 22. It is also understood that to provide for this silhouetted sighting notch, rear sight plate 22 must have a larger sight notch than front sight plate 21 as shown in FIGS. 7 and 8. Glare-proof characteristics of the rear sight can be further enhanced by coating the underside of the slanted front plate with a dull nonreflective finish, and this finish is inherently protected by the rear plate. As with all other sight designs, coating the entire sight with a nonreflective finish is more desirable.

In the light of the foregoing various methods of fabricating and attaching the double sight blade to the sight leaf are apparent. Other ramifications will also occur to one skilled in the art. Thus removing material from the center area of sight leaf 10 or thinning down this part along the span will lighten its spring action and weight. The sight leaf can be provided with scale markers and pointers which serve as reference points for elevation adjustments. In addition the adjustment screw 16 can be made with dimpled cuts on the outer edge of its head to register with a dimple in the sight leaf. This screw provides microadjustment for elevation, as well as holding the sight leaf in place. And a set screw 7 can be utilized for added assurance in securing the sight to the gun. The set screw is located in the center of the base plate to minimize distortion and balance out any local stresses. Such modifications are deemed to be within the scope of this invention.

I claim:

1. In a rear sight for firearms, the combination of a resilient sight leaf and means biasing the sight leaf vertically for elevation adjustment, with a double sight element attached to the sight leaf and adjustment means for sliding the double sight element laterally for windage adjustment, the double sight element including two sight plates disposed one behind the other in the line of sight forming a front plate and a rear plate, the front plate relative to the line of sight having a smaller notch than the rear plate, the front plate, again relative to the line of sight, having different reflective properties from the rear plate, the notch size and reflective property differences resulting in a silhouetted sighting groove.

2. The rear sight of claim 1 wherein the reflective property differences are a result of a slanting front plate of the double sight element.

3. The rear sight of claim 1 wherein the reflective property differences are a result of coated sight plates.

4. The rear sight of claim 1 having a dovetail fitting for attachment to a pistol.

* * * * *